United States Patent [19]

Dörling et al.

[11] Patent Number: 4,457,764

[45] Date of Patent: Jul. 3, 1984

[54] TWO-STAGE GASIFIER

[75] Inventors: Rolf Dörling; Ulrich Premel, both of Gummersbach, Fed. Rep. of Germany

[73] Assignee: L & C Steinmüller GmbH, Gummersbach, Fed. Rep. of Germany

[21] Appl. No.: 469,789

[22] Filed: Feb. 9, 1983

[30] Foreign Application Priority Data

Feb. 15, 1982 [DE] Fed. Rep. of Germany ..... 3205346

[51] Int. Cl.[3] ..... B01J 3/00; C10J 3/20; C10J 3/76

[52] U.S. Cl. ..... 48/62 R; 48/DIG. 2; 48/67; 48/69; 48/77; 422/189

[58] Field of Search ..... 48/67, 77, 128, 210, 48/DIG. 2, 62 R, 69; 422/194, 189, 202, 232; 202/227; 60/39.464, 39.12

[56] References Cited

U.S. PATENT DOCUMENTS

| | | | |
|---|---|---|---|
| 3,951,615 | 4/1976 | Gernhardt et al. | 48/77 |
| 3,988,123 | 10/1976 | Coates | 48/77 |
| 4,272,255 | 6/1981 | Coates | 48/77 |
| 4,368,103 | 1/1983 | Weinzierl et al. | 202/227 |

*Primary Examiner*—S. Leon Bashore, Jr.

*Assistant Examiner*—K. M. Hastings

*Attorney, Agent, or Firm*—Becker & Becker

[57] ABSTRACT

A flue-stream reactor for gasifying fossil fuels which contain ballast. The reactor comprises two cylindrical, cooled, and insulated reaction chambers which are disposed one after the other in the axial direction. The first reaction chamber is provided with an axial inlet for accommodating a gasification burner. The second reaction chamber is provided with an opening for the addition of gasification material. A cooled, coaxial channel provides communication between the two reaction chambers. The reactor further includes a radial discharge and a device for removing liquid and solid ash and slag. As viewed in the axial direction of flow, the first reaction chamber includes a cooled deflection hood ahead of the inlet of the connecting channel, thereafter a cooled, annular, trough-like device which is intended for collecting liquid ash and slag, is disposed on the wall of the chamber, and is provided with a discharge, and thereunder a water bath which is disposed between the connecting channel and the wall of the chamber; the second reaction chamber is provided ahead of the outlet with a cooled deflection hood which is furthermore disposed above the funnel-shaped discharge for the solid ash and slag.

1 Claim, 1 Drawing Figure

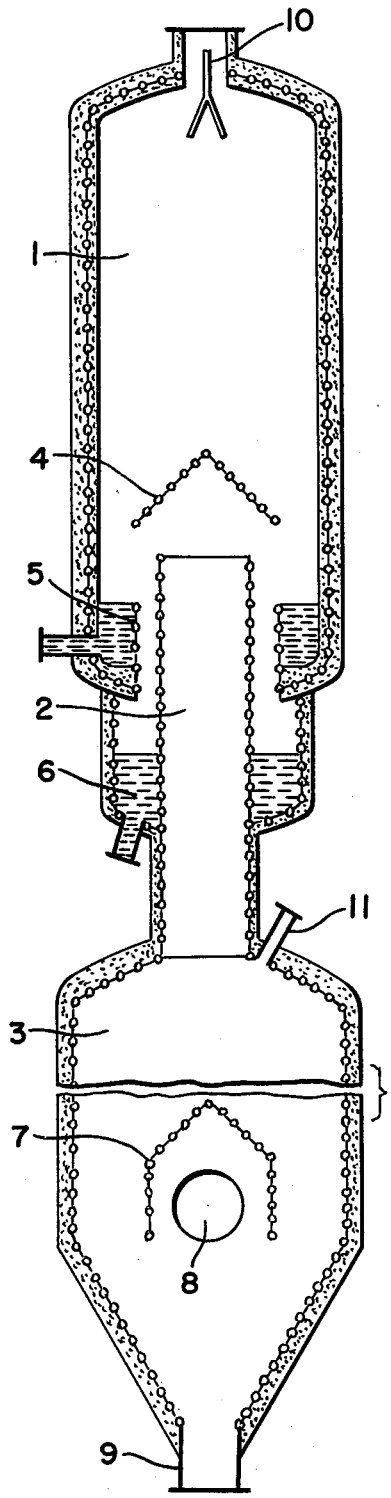
10
1
4
5
2
6
11
3
7
8
9

TWO-STAGE GASIFIER

BACKGROUND OF THE INVENTION

The present invention relates to a flue-stream reactor for gasifying fossil fuels which contain ballast. The reactor comprises two cylindrical, cooled, and insulated reaction chambers which are disposed one after the other in the axial direction. The first reaction chamber is provided with an axial opening for accommodating a gasification burner. The second reaction chamber is provided with an opening for the addition of gasification material. A coaxial, cooled channel provides communication between the two reaction chambers. The reactor further includes a radial outlet and with a device for separating liquid and solid ash and slag.

Flue-stream reactors of the aforementioned general type are known in which the liquid and solid ash and slag are separated in a single separating device from the product stream which results from a gasification of fossil fuels which contain ballast. All of these devices whether they are a liquid slag bath, a water bath, or exclusively a solid discharge after having previously received the liquid ash particles, have the drawback that due to the varying condition and composition of liquid and solid ash particles, a homogeneous, continuous, and complete separation is not possible.

Another drawback is that, as a result of the reaction conditions which are determined by the flue-stream gasification and which prevail varyingly in the reactor, an optimum method, with the objective of a complete separation, is not always possible in a single separation device for liquid and solid ash and slag.

It is an object of the present invention to design a flue-stream reactor of the aforementioned general type in such a way that the ash and slag, which are produced during the gasification of fossil fuels which contain ballast, and which gasification takes place in the flue stream, are separated out of the reaction product stream, in conformity to the reaction conditions in the reactor, in the liquid state in the first reaction chamber and in the solid state in the second reaction chamber, as a result of which a flow-free process operation with a nearly 100% ash and slag discharge is assured.

SUMMARY OF THE INVENTION

The flue-stream reactor of the present invention is characterized primarily in that, as viewed in the axial direction of flow, that reaction chamber of the flue-stream reactor which is located ahead of the inlet of the connecting channel includes a cooled deflection hood, thereafter a cooled, annular trough-like device which is intended for collecting liquid ash and slag, is located on the wall of the chamber, and is provided with a discharge, and thereunder a water bath which is disposed between the connecting channel and the wall of the chamber; and in that that reactor of the flue-stream reactor which is located ahead of the outlet is provided with a cooled deflection hood above the funnel-shaped discharge for the solid ash and slag.

BRIEF DESCRIPTION OF THE DRAWING

This object, and other objects and advantages of the present invention, will appear more clearly from the following specification in connection with the accompanying drawing, which illustrates one embodiment of the reactor of the present invention.

DESCRIPTION OF A PREFERRED EMBODIMENT

Referring now to the drawing in detail, an inventive flue-stream reactor for gasification of fossil fuels which contain ballast comprises the cylindrical, cooled, and insulated reaction chambers 1 and 3. These reaction chambers 1 and 3 are arranged one after the other in the axial direction, and communicate with one another by means of the channel 2 which is disposed in the common axis. The coaxial gasification burner 10 is located at the top of the reaction chamber 1. The reaction material which is necessary for the flue-stream gasification is introduced into the chamber 1 in a downward stream by means of the gasification burner 10. The reaction stream resulting from the gasification strikes the deflection hood 4 and leaves the chamber 1 via the connecting channel 2 after being deflected twice, and by at least 90°. A cooled, annular collection trough 5, which is located on the wall of the chamber 1, serves to collect liquid ash and slag which is carried out of the reaction product stream onto the wall of the chamber or onto the topside of the deflection hood 4; an auxiliary device makes possible a continuous removal of liquid slag. An annular space between the connecting channel 2 and the slag bath trough 5 makes it possible to be able to collect the liquid slag which has overflowed the trough 5 in the water bath 6 which is located below the trough 5 and between the connecting channel 2 and the wall of the chamber 1. The arrangement of the water bath 6 in the chamber 1 has the advantage that the surface of the water has no direct contact with the hot reaction product stream. The level of separation of ash and slag in the reaction chamber 1 is approximately 50%.

The reaction product stream, which conveys the remainder of solid ash and slag particles, leaves the chamber 1 via the connecting channel 2 and flows into the reaction chamber 3, in which cooling surfaces assure a cooling-off of the reaction product stream to a temperature which is below the fusion point.

An opening or inlet 11 in the reaction chamber 3 permits the addition of further gasification material in order to affect the quality and temperature of the gas. By means of a deflection hood 7 above the outlet 8, and by means of the funnel-shaped discharge 9 for the solid ash and slag, the reaction product stream, before it leaves the reaction chamber 3 via the outlet 8, undergoes a further at least 90° deflection, as a result of which a dry separation of the remaining ash and slag from the reaction product stream is effected.

The inventive structural design of a flue-stream reactor offers the advantage that even those fossil fuels having a greatly fluctuating proportion of ash can be completely gasified, and that, in conformity with the conditions of the reaction in the reactor, liquid as well as solid ash and slag separation assure a reliable process operation.

The present invention is, of course, in no way restricted to the specific disclosure of the specification and drawing, but also encompasses any modifications within the scope of the appended claims.

What we claim is:

1. A flue-stream reactor for gasifying fossil fuels which contain ballast, said reactor comprising:

a first cylindrical, cooled, and insulated reaction chamber, which includes an axial inlet for accommodating a gasification burner;

a second cylindrical, cooled, and insulated reaction chamber, which includes an inlet for the addition of gasification material; said second reaction chamber further including a radial outlet disposed transverse to the axial direction of said second chamber, and a funnel-shaped discharge for solid ash and slag; said first and second reaction chambers being disposed one after the other in the axial direction thereof;

a cooled channel which is coaxial with, interconnects, and provides communication between said first and second reaction chambers; as viewed in the axial direction of flow, said connecting channel has an inlet which communicates with said first chamber, and an outlet which communicates with said second chamber; said burner in said axial inlet of said first chamber being located at that end thereof remote from said inlet of said connecting channel, and said funnel-shaped discharge of said second chamber being located at that end thereof remote from said outlet of said connecting channel;

a cooled deflection hood located in said first reaction chamber ahead of said inlet of said connecting channel when viewed in the axial direction of flow;

a cooled, annular, trough-like device for collecting liquid ash and slag, said trough-like device being provided with a discharge opening, and being disposed on the inner wall of said first reaction chamber after said inlet of said connecting channel when viewed in the axial direction of flow;

a water bath disposed between said connecting channel and the inner wall of said first reaction chamber after said trough-like device when viewed in the axial direction of flow; and a cooled second deflection hood located in said second reaction chamber ahead of said radial outlet and said funnel-shaped discharge when viewed in the axial direction of flow.

* * * * *